US011498342B2

(12) United States Patent
Abe

(10) Patent No.: US 11,498,342 B2
(45) Date of Patent: Nov. 15, 2022

(54) THERMAL HEAD AND THERMAL PRINTER

(71) Applicant: KYOCERA Corporation, Kyoto (JP)

(72) Inventor: Hironari Abe, Kirishima (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 17/279,744

(22) PCT Filed: Sep. 27, 2019

(86) PCT No.: PCT/JP2019/038153
§ 371 (c)(1),
(2) Date: Mar. 25, 2021

(87) PCT Pub. No.: WO2020/067424
PCT Pub. Date: Apr. 2, 2020

(65) Prior Publication Data

US 2022/0032649 A1 Feb. 3, 2022

(30) Foreign Application Priority Data

Sep. 27, 2018 (JP) ..... JP2018-182269

(51) Int. Cl.
*B41J 2/335* (2006.01)
*B41J 2/345* (2006.01)
(Continued)

(52) U.S. Cl.
CPC ..... *B41J 2/3353* (2013.01); *B41J 2/335* (2013.01); *B41J 2/3351* (2013.01); *B41J 2/3352* (2013.01);
(Continued)

(58) Field of Classification Search
CPC .... B41J 2/3353; B41J 2/3351; B41J 11/0055; B41J 11/70; B41J 2/3357; B41J 2/335;
(Continued)

(56) References Cited

U.S. PATENT DOCUMENTS

2009/0174757 A1 7/2009 Sako et al.
2010/0147166 A1 6/2010 Hirota et al.
(Continued)

FOREIGN PATENT DOCUMENTS

CN 108349265 A 7/2018
JP 11-334123 A 12/1999
(Continued)

*Primary Examiner* — Yaovi M Ameh
(74) *Attorney, Agent, or Firm* — Volpe Koenig

(57) ABSTRACT

A thermal head includes a substrate, a heat-generating portion, electrodes, and a protective layer. The heat-generating portion is located on the substrate. The electrodes are located on the substrate and are connected to the heat-generating portion. The protective layer covers the heat-generating portion and parts of the electrodes. Further, a kurtosis Rku of the protective layer is smaller than 3. A thermal head includes a substrate, a heat-generating portion, electrodes, and a protective layer. The heat-generating portion is located on the substrate. The electrodes are located on the substrate and are connected to the heat-generating portion. The protective layer covers the heat-generating portion and parts of the electrodes. Further, a skewness Rsk of the protective layer is smaller than 0.

10 Claims, 6 Drawing Sheets

(51) Int. Cl.
*B41J 11/00* (2006.01)
*B41J 11/70* (2006.01)

(52) U.S. Cl.
CPC ..... *B41J 2/3354* (2013.01); *B41J 2/3357* (2013.01); *B41J 2/33515* (2013.01); *B41J 2/345* (2013.01); *B41J 11/0055* (2013.01); *B41J 11/70* (2013.01)

(58) Field of Classification Search
CPC .... B41J 2/33515; B41J 2/3352; B41J 2/3354; B41J 2/345
See application file for complete search history.

(56) References Cited

U.S. PATENT DOCUMENTS

| | | | | |
|---|---|---|---|---|
| 2016/0325557 | A1* | 11/2016 | Ookubo | B41J 2/3354 |
| 2019/0061371 | A1 | 2/2019 | Ishii | |

FOREIGN PATENT DOCUMENTS

| | | | | | |
|---|---|---|---|---|---|
| JP | 2004-209728 | A | | 7/2004 | |
| JP | 2005007575 | A | * | 1/2005 | B41N 1/14 |
| JP | 2010-149515 | A | | 7/2010 | |
| JP | 2017134196 | A | * | 8/2017 | G03G 15/08 |
| WO | 2007/148663 | A1 | | 12/2007 | |
| WO | WO-2018181734 | A1 | * | 10/2018 | B41J 2/3354 |

* cited by examiner

THERMAL HEAD AND THERMAL PRINTER

TECHNICAL FIELD

The present disclosure relates to a thermal head and a thermal printer.

BACKGROUND ART

Conventionally, as a printing device of facsimiles, video printers, etc., various thermal heads have been proposed. For example, known in the art is a thermal head provided with a substrate, heat-generating portions positioned on the substrate, electrodes which are positioned on the substrate and are connected to the heat-generating portions, and a protective layer covering the heat-generating portions and parts of electrodes (see Patent Literature 1).

CITATION LIST

Patent Literature

Patent Literature 1: International Patent Publication No. 2007/148663

SUMMARY OF INVENTION

A thermal head of the present disclosure includes a substrate, a heat-generating portion, an electrode, and a protective layer. The heat-generating portion is located on the substrate. The electrode is located on the substrate and is connected to the heat-generating portion. The protective layer covers the heat-generating portion and a part of the electrode. Further, a kurtosis Rku of the protective layer is smaller than 3.

A thermal printer of the present disclosure includes a thermal head described above, a conveyance mechanism which conveys a recording medium onto the protective layer which is located on the heat-generating portion, and a platen roller pressing against the recording medium.

DESCRIPTION OF EMBODIMENTS

In a conventional thermal head, in order to improve slip of the protective layer, use is made of a protective layer in which the contact surface of the protective layer is formed with surface relief in order to make the contact area with the recording medium smaller. Due to that, the recording medium becomes harder to stick to the protective layer, so it becomes harder for so-called sticking to occur.

However, in the conventional thermal head described above, an external force from the platen roller pressing against the recording medium is concentrated to the convex portions, therefore the abrasion resistance of the protective layer is low.

A thermal head in the present disclosure maintains slip of the protective layer while improves the abrasion resistance of the protective layer. Below, a thermal head in the present disclosure and a thermal printer using the same will be explained in detail.

First Embodiment

Figure 1:
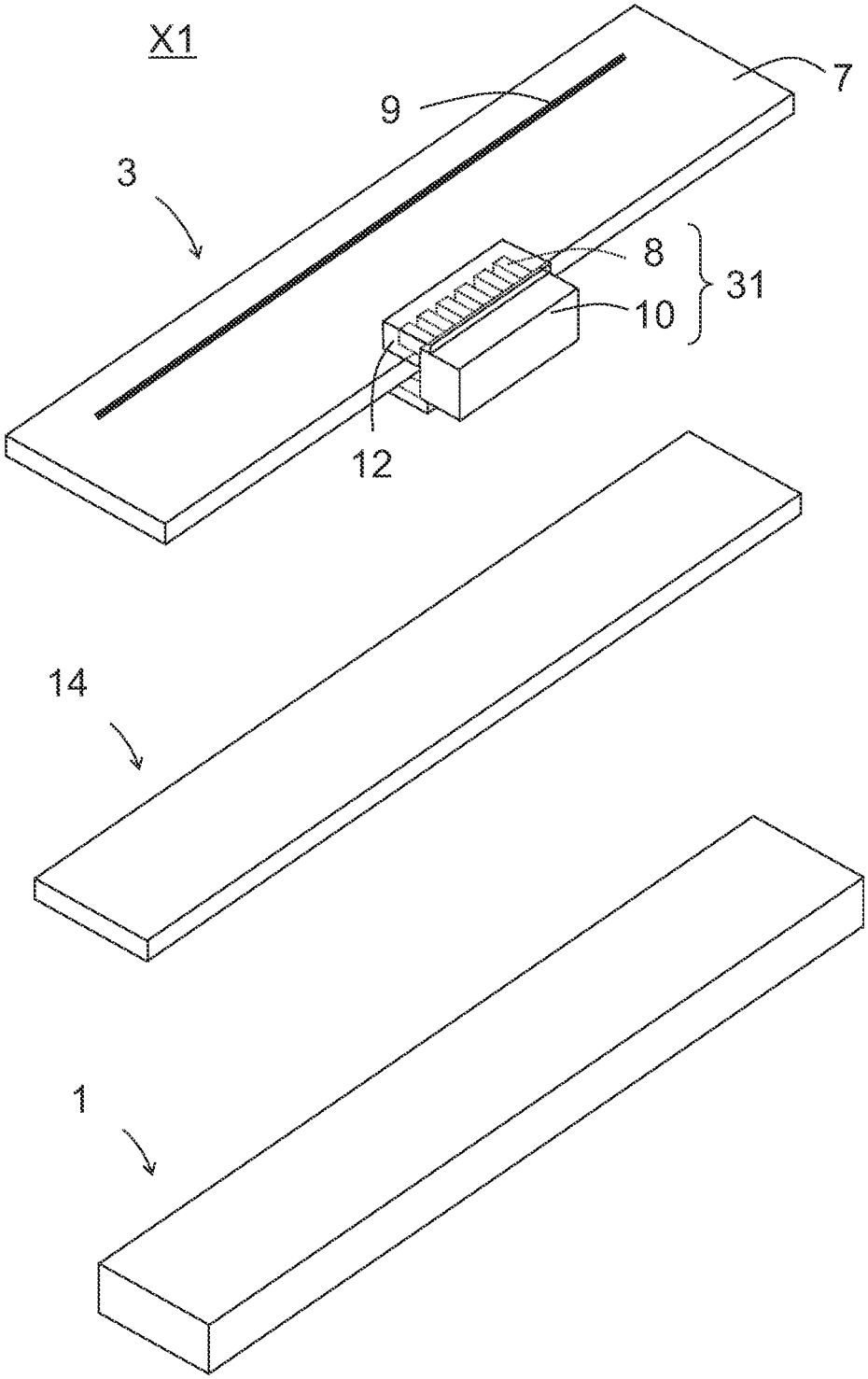
FIG. 1 is a disassembled perspective view showing an outline of a thermal head according to a first embodiment.
Figure 2:
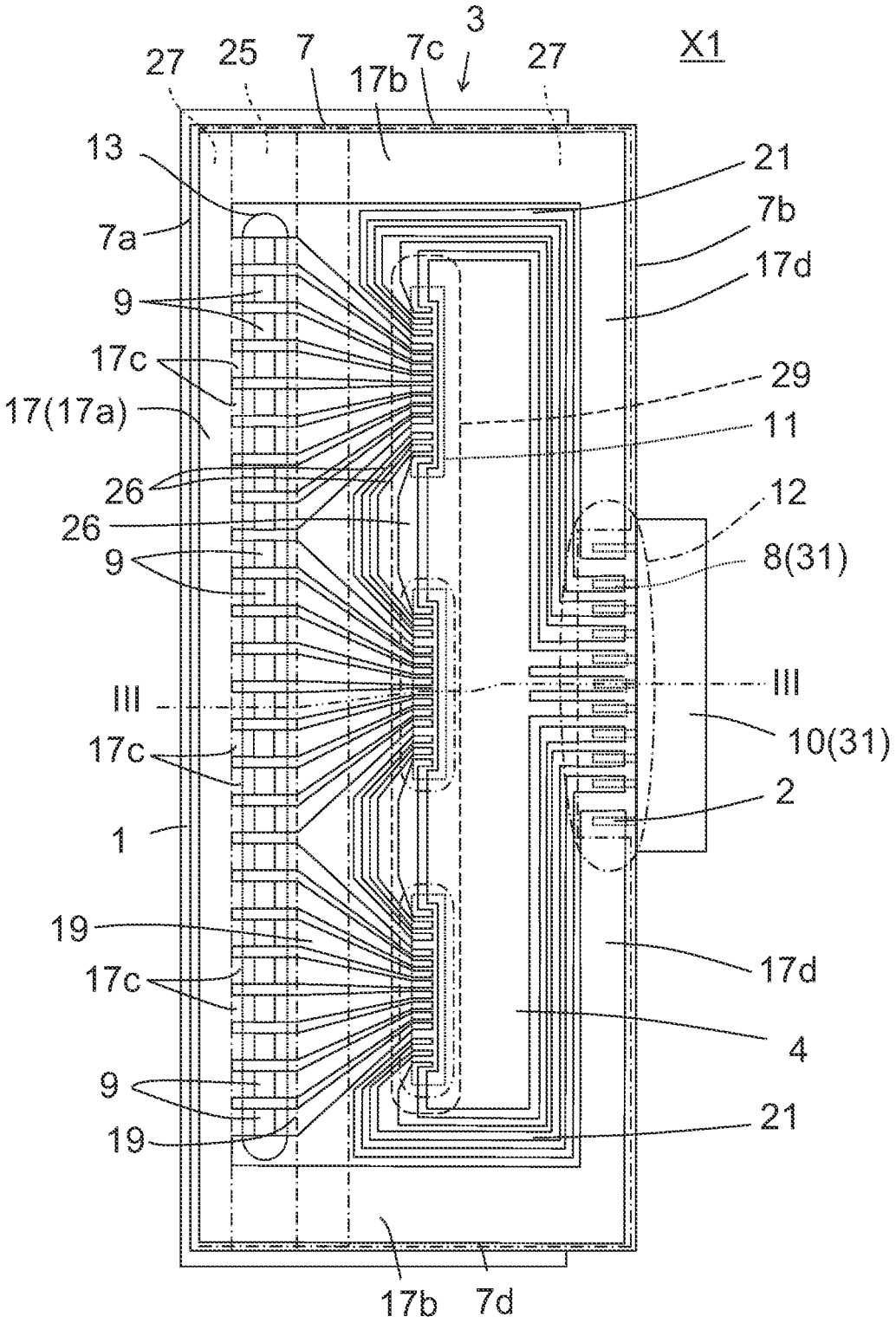
FIG. 2 is a plan view showing the outline of the thermal head shown in FIG. 1.
Figure 3:
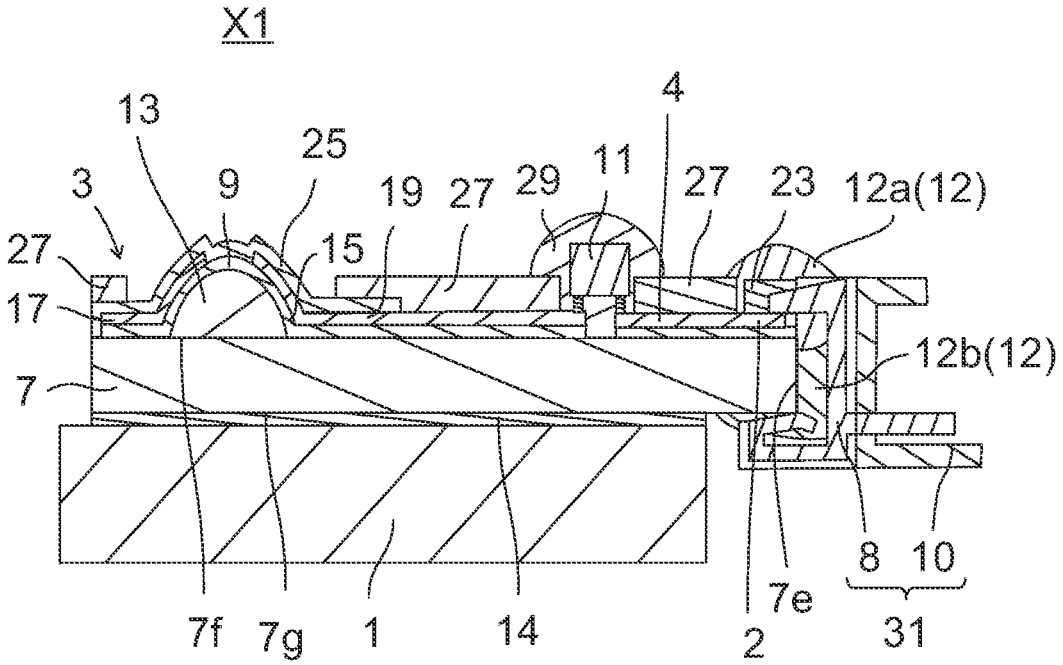
FIG. 3 is a cross-sectional view taken along the line in FIG. 2.
Figure 4:
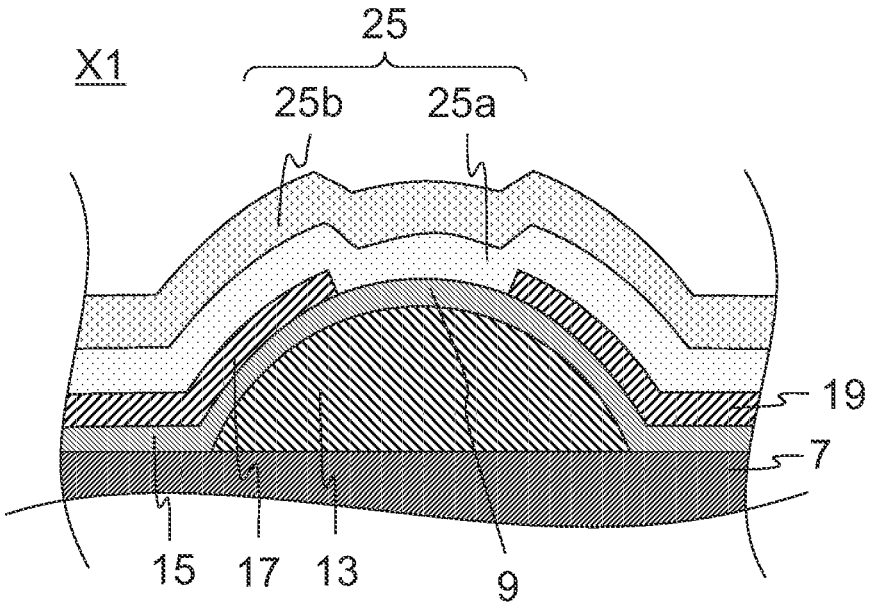
FIG. 4 is a cross-sectional view showing enlarged the vicinity of a protective layer in the thermal head shown in FIG. 1.

Below, a thermal head X1 will be explained with reference to FIGS. 1 to 4. FIG. 1 schematically shows the configuration of the thermal head X1. FIG. 2 shows a protective layer 25, coating layer 27, and sealing member 12 by one-dot chain lines and shows a coating member 29 by a broken line. FIG. 3 is a cross-sectional view taken along the line in FIG. 2. FIG. 4 shows enlarged the vicinity of the protective layer 25 in the thermal head X1.

The thermal head X1 is provided with a head base body 3, connector 31, sealing member 12, heat-radiating plate 1, and bonding member 14. Note that, the connector 31, sealing member 12, heat-radiating plate 1, and bonding member 14 need not necessarily be provided.

The heat-radiating plate 1 radiates excessive heat of the head base body 3. The head base body 3 is placed on the heat-radiating plate 1 through the bonding member 14. The head base body 3 performs printing on a recording medium P (see FIG. 5) by application of voltage from an external portion. The bonding member 14 bonds the head base body 3 and the heat-radiating plate 1. The connector 31 electrically connects the head base body 3 to the external portion. The connector 31 has connector pins 8 and a housing 10. The sealing member 12 joins the connector 31 and the head base body 3.

The heat radiating plate 1 is cuboid shaped. The heat radiating plate 1 is for example formed by copper, iron, aluminum, or another metal material and has the function of radiating heat which does not contribute to the printing in the heat generated in the heat-generating portions 9 in the head base body 3.

The head base body 3 is rectangle shaped when viewed on a plane and has members configuring the thermal head X1 arranged on a substrate 7. The head base body 3 has a function of printing on the recording medium P according to an electrical signal supplied from the external portion.

Using FIGS. 1 to 3, the members configuring the head base body 3, the sealing member 12, bonding member 14, and connector 14 will be explained.

The head base body 3 has the substrate 7, heat storage layer 13, electrical resistance layer 15, common electrode 17, individual electrodes 19, first connection electrodes 21, connection terminals 2, conductive member 23, driving ICs (integrated circuits) 11, coating member 29, protective layer 25, and coating layer 27. Note that, all of these members need not be provided. Further, the head base body 3 may be provided with members other than them as well.

The substrate 7 is arranged on the heat radiating plate 1 and is rectangle shaped when viewed on a plane. The substrate 7 has a first surface 7*f*, second surface 7*g*, and side surface 7*e*. The first surface 7*f* has a first long side 7*a*, second long side 7*b*, first short side 7*c*, and second short side 7*d*. The members configuring the head base body 3 are arranged on the first surface 7*f*. The second surface 7*g* is positioned on the opposite side to the first surface 7*f*. The second surface 7*g* is positioned on the heat radiating plate 1 side and is bonded to the heat radiating plate 1 through the bonding member 14. The side surface 7*e* connects the first surface 7*f* and the second surface 7*g* and is positioned on the second long side 7*b* side.

The substrate 7 is for example formed by an alumina ceramic or other electrical insulating material or single crystal silicon or other semiconductor material or the like.

The heat storage layer 13 is positioned on the first surface 7*f* of the substrate 7. The heat storage layer 13 protrudes upward from the first surface 7*f*. In other words, the heat storage layer 13 projects in a direction away from the first surface 7*f* of the substrate 7.

The heat storage layer 13 is arranged so as to be adjacent to the first long side 7*a* of the substrate 7 and extends along the main scanning direction. By the cross-section of the heat storage layer 13 being schematically semiellipsoidal in shape, the protective layer 25 formed on the heat-generating portions 9 contacts well the recording medium P for printing. The height of the heat storage layer 13 from the first surface 7*f* of the substrate 7 can be made 30 to 60 μm.

The heat storage layer 13 is formed by a glass having a low thermal conductivity and temporarily stores a part of the heat generated in the heat-generating portions 9. For this reason, the time required for raising the temperature of the heat-generating portions 9 can be made shorter, therefore the thermal response characteristic of the thermal head X1 can be raised.

The heat storage layer 13 is for example formed by coating a predetermined glass paste, obtained by mixing a suitable organic solvent with glass powder, on the first surface 7*f* of the substrate 7 by screen printing or the like and firing it.

The electrical resistance layer 15 is positioned on the upper surface of the heat storage layer 13. On the electrical resistance layer 15, the common electrode 17, individual electrodes 19, first connection electrodes 21, and second connection electrodes 26 are formed. Between the common electrode 17 and the individual electrodes 19, exposed regions where the electrical resistance layer 15 is exposed are formed. The exposed regions of the electrical resistance layer 15 are arranged in a row on the heat storage layer as shown in FIG. 2. The exposed regions configure the heat-generating portions 9.

Note that, the electrical resistance layer 15 need not be positioned between various electrodes and the heat storage layer 13. For example, it may be positioned only between the common electrode 17 and the individual electrodes 19 so as to electrically connect the common electrode 17 and the individual electrodes 19 as well.

The plurality of heat-generating portions 9 are described simplified in FIG. 2 for convenience of explanation. However, for example, they are arranged with a density of 100 dpi to 2400 dpi (dot per inch) or the like. The electrical resistance layer 15 is for example formed by a material having a relatively high electrical resistance such as a TaN, TaSiO, TaSiNO, TiSiO, TiSiCO, or NbSiO based material. For this reason, when voltage is supplied to the heat-generating portions 9, the heat-generating portions 9 generate heat by Joule heating.

The common electrode 17 is provided with main wiring portions 17*a* and 17*d*, sub-wiring portions 17*b*, and lead portions 17*c*. The common electrode 17 electrically connects the plurality of heat-generating portions 9 and the connector 31. The main wiring portion 17*a* extends along the first long side 7*a* of the substrate 7. The sub-wiring portions 17*b* respectively extend along the first short side 7*c* and second short side 7*d* of the substrate 7. The lead portions 17*c* individually extend from the main wiring portion 17*a* toward the heat-generating portions 9. The main wiring portions 17*d* extend along the second long side 7*b* of the substrate 7.

The plurality of individual electrodes 19 electrically connect the heat-generating portions 9 and the driving ICs 11. Further, the plurality of heat-generating portions 9 are divided into a plurality of groups. The groups of heat-generating portions 9 and the driving ICs 11 which are arranged corresponding to the groups are electrically connected by the individual electrodes 19.

The plurality of first connection electrodes 21 electrically connect the driving ICs 11 and the connector 31 to each other. A plurality of the first connection electrodes 21 connected to each of the driving ICs 11 are configured by a plurality of wirings having different functions.

The plurality of second connection electrodes 26 electrically connect the adjoining driving ICs 11. The plurality of second connection electrodes 26 are configured by pluralities of wirings having different functions.

These common electrode 17, individual electrodes 19, first connection electrodes 21, and second connection electrodes 26 are formed by materials having conductivity. For example, they are formed by one type of metal of any of aluminum, gold, silver, and copper or an alloy of the same.

The plurality of connection electrodes 2 are arranged on the second long side 7*b* side of the first surface 7*f* in order to connect the common electrode 17 and first connection electrodes 21 to the FPC 5. The connection terminals 2 are arranged corresponding to later explained connector pins 8 in the connector 31.

A conductive member 23 is provided on each connection terminal 2. As the conductive member 23, for example, solder or ACP (anisotropic conductive paste) or the like can be illustrated. Note that, between the conductive member 23 and the connection terminal 2, a plating layer of Ni, Au, or Pd may be arranged as well.

The various electrodes configuring the head base body 3 described above can be formed by successively stacking material layers made of Al, Au, Ni, or another metal configuring each on the heat storage layer 13 by a sputtering process or other thin film forming technique, then processing the stack into predetermined patterns by using photo-etching or the like. Note that, the various electrodes configuring the head base body 3 can be simultaneously formed by using the same manufacturing process.

The driving ICs 11, as shown in FIG. 2, are arranged corresponding to the groups of the plurality of heat-generating portions 9. Further, the driving ICs 11 are connected to the individual electrodes 19 and first connection electrodes 21. The driving ICs 11 have the functions of controlling the conduction states of the heat-generating portions 9. As the driving ICs 11, use can be made of switching ICs.

The protective layer 25 coats the heat-generating portions 9 and parts of the common electrode 17 and individual electrodes 19. The protective layer 25 is one for protecting the coated regions from corrosion due to deposition of moisture etc. contained in the atmosphere or abrasion due to contact with the recording medium P for printing.

The coating layer 27 is arranged on the substrate 7 so as to partially coat the common electrode 17, individual electrodes 19, first connection electrodes 21, and second connection electrodes 26. The coating layer 27 is one for protecting the coated regions from oxidation due to contact with the atmosphere or corrosion due to deposition of moisture etc. contained in the atmosphere. The coating layer 27 can be formed by a resin material such as an epoxy resin, polyimide resin, or silicone resin.

The driving ICs 11 are sealed by the coating member 29 made of an epoxy resin or silicone resin or another resin in a state where they are connected to the individual electrodes 19, first connection electrodes 21, and second connection electrodes 26. The coating member 29 is arranged so as to extend in the main scanning direction and integrally seals the plurality of driving ICs 11.

The connector 31 has the plurality of connector pins 8 and the housing 10 accommodating the plurality of connector pins 8. The plurality of connector pins 8 have first ends and second ends. The first ends are exposed to the external portion of the housing 10, while the second ends are accommodated inside the housing 10 and are led out to the external portion. The first ends of the connector pins 8 are electrically connected to the connection terminals 2 of the head base body 3. Due to that, the connector 31 is electrically connected with the various electrodes in the head base body 3.

The sealing member 12 has a first sealing member 12*a* and second sealing member 12*b*. The first sealing member 12*a* is positioned on the first surface 7*f* of the substrate 7. The first sealing member 12*a* seals the connector pins 8 and various electrodes. The second sealing member 12*b* is positioned on the second surface 7*g* of the substrate 7. The second sealing member 12*b* is arranged so as to seal the connection portions of the connector pins 8 and the substrate 7.

The sealing member 12 is arranged so that the connection terminals 2 and the first ends of the connector pins 8 are not exposed to the external portion. For example, the sealing member 12 can be formed by an epoxy-based thermosetting resin, ultraviolet curing resin, or visible light-curable resin. Note that, the first sealing member 12*a* and the second sealing member 12*b* may be formed by the same material. Further, the first sealing member 12*a* and the second sealing member 12*b* may be formed by different materials.

The bonding member 14 is arranged on the heat radiating plate 1 and bonds the second surface 7*g* of the head base body 3 and the heat radiating plate 1. As the bonding member 14, a double-sided tape or resin adhesive can be illustrated.

The protective layer 25 will be explained in detail by using FIG. 4.

The protective layer 25 is provided with a first layer 25*a* and second layer 25*b*. The first layer 25*a* is positioned on the substrate 7. In more detail, the first layer 25*a* coats the entire regions of the heat-generating portions 9. Further, the first layer 25*a*, as shown in FIG. 2, coats parts of the electrodes. In more detail, the first layer 25*a* coats the entire region of the main wiring portion 17*a*, parts on the first long side 7*a* side in the sub-wiring portions 17*b*, and the entire regions of the lead portions 17*c*. Further, the first layer 25*a* coats parts on the heat-generating portion 9 sides in the individual electrodes 19.

As the first layer 25*a*, SiN, SiON, $SiO_2$, SiAlON, SiC, and the like can be illustrated.

The thickness of the first layer 25*a* can be set to 2 to 10 μm. By setting the thickness of the first layer 25*a* to 2 μm or more, the electrical insulation property of the individual electrodes 19 is improved. Further, by setting the thickness of the first layer 25*a* to 6 μm or less, it becomes easier to transfer the heat of the heat-generating portions 9 to the recording medium P, therefore the thermal efficiency of the thermal head X1 is improved.

As the second layer 25*b*, TiN, TiON, TiCrN, TiAlON, and the like can be illustrated. Where use is made of TiN as the second layer 25*b*, for example, it can be set so as to contain 40 to 60 at. % of Ti and 40 to 60 at. % of N.

The thickness of the second layer 25*b* can be set to 2 to 6 μm. By setting the thickness of the second layer 25*b* to 2 μm or more, the abrasion resistance is improved. Further, by setting the thickness of the second layer 25*b* to 6 μm or less, it becomes easier to transfer the heat of the heat-generating portions 9 to the recording medium P, therefore the thermal efficiency of the thermal head X1 is improved. Note that, the second layer 25*b* corresponds to the outermost layer and is one contacting the recording medium P.

The arithmetic average roughness Ra of the second layer 25*b* is for example 67.7 μm or less. Due to that, a contact area between the second layer 25*b* and the recording medium P can be made smaller. Therefore, the friction force generated on the second layer 25*b* and the recording medium P can be reduced. As a result, the abrasion resistance of the second layer 25*b* can be improved. Note that, the arithmetic average roughness Ra is the value prescribed in JIS B 0601 (2013).

The kurtosis Rku of the second layer 25*b* is smaller than 3. For example, it is set at 0.1 to 2.9. The kurtosis Rku is an index indicating the scale of the sharpness, that is, the kurtosis, of the surface state. If the kurtosis Rku is smaller than 3, it indicates that the surfaces of the crests are flat in a macroscopic view and there are small crests or valleys on the surfaces of the crests in a microscopic view. Further, if the kurtosis Rku is larger than 3, it indicates that the surfaces of the crests are not flat in a macroscopic view and there are many sharp crests and valleys on the surfaces of the crests in a microscopic view. Note that, the kurtosis Rku is the value prescribed in JIS B 0601 (2013).

The skewness Rsk of the second layer 25*b* is smaller than 0. For example, it is set at −0.2 to −2.0. The skewness Rsk is an index indicating the ratio of the crest parts and the valley parts using the mean height in the roughness curve as the center line. If the skewness Rsk is larger than 0, it indicates that there are the valley parts more than the crest parts. Further, If the skewness Rsk is smaller than 0, it indicates that there are the crest parts more than the valley parts. Note that, the skewness Rsk is the value prescribed in JIS B 0601 (2013).

Here, there is known a protective layer in which the contact surface of the protective layer is formed with surface relief in order to make the contact area with the recording medium smaller. However, due to the concentration of the external force from the recording medium to the projecting parts, the projecting parts are abraded, therefore sometimes the abrasion resistance of the protective layer is low. Further, when the projecting parts are abraded, the contact surface of the protective layer becomes closer to flatness, therefore the contact area with the recording medium becomes larger. Due to that, the recording medium ends up sticking to the protective layer, so sometimes sticking sometimes arises.

Contrary to this, the thermal head X1 in the present disclosure is configured with the kurtosis Rku of the second layer 25*b* smaller than 3. Due to that, the surface of the second layer 25*b* is structured with the surfaces of the crests flat in a macroscopic view and with small crests or valleys on the surface of the crest in a microscopic view. In other words, it is structured with a plurality of crests having a large waviness and fine crests or valleys on the surface of the former crests.

For this reason, the thermal head X1 is structured with the recording medium P supported while having a certain extent of contact area due to crests having a large waviness and having gaps between the recording medium P and the second layer 25*b* due to fine crests. As a result, the second layer 25*b* becomes harder to be abraded, and the recording medium P becomes harder to stick to the second layer 25*b*. Therefore, a thermal head X1 improving the abrasion resistance and hardly suffering from sticking can be provided.

Further, the recording medium P becomes harder to stick to the second layer 25*b*, therefore it becomes harder for sticking to occur and an thermal head X1 improved in slip can be formed. Further, since the recording medium P becomes harder to stick to the second layer 25*b*, the printing noise becomes smaller, so a thermal printer Z1 having little noise can be provided. Further, since the recording medium P becomes harder to stick to the second layer 25*b*, in a thermal transfer printing method using an ink ribbon, wrinkles become harder to be formed in the ink ribbon. As a result, the thermal head X1 can perform fine printing.

Further, in the thermal head X1 in the present disclosure, the kurtosises Rku of the second layers 25*b* which are positioned at the two end portions in the long direction of the substrate 7 (hereinafter, simply referred to as the long direction) may be larger than the kurtosis Rku of the second layer 25*b* which is positioned at the center portion in the long direction as well.

According to the above configuration, the contact area of the second layer 25*b* positioned at the center portion in the long direction with the recording medium P becomes larger than the contact area of the second layer 25*b* which is positioned at the two end portions in the long direction with the recording medium P. As a result, in the long direction, the friction force by the recording medium P and the second layer 25*b* becomes larger in the center portion than that at the two end portions.

Therefore, when wrinkles are going to be formed at the recording medium P, the wrinkles can be released from the center portion in the long direction toward the two end portions having a small friction force. As a result, together with the conveyance of the recording medium P, the wrinkles are stretched, therefore wrinkles become harder to be formed on the recording medium P.

Further, the thermal head X1 in the present disclosure may be configured with the skewness Rsk of the second layer 25*b* smaller than 0 as well. For this reason, the surface of the second layer 25*b* is configured with more crest parts compared with the valley parts. As a result, the contact area between the recording medium P and the second layer 25*b* can be increased. Therefore, the recording medium P is supported by the crest parts while a plurality of gaps are positioned between the surface and the recording medium P due to the valley parts. Due to that, the recording medium P becomes harder to stick to the second layer 25*b*.

The recording medium P becomes harder to stick to the second layer 25*b*, therefore sticking becomes harder to occur, so a thermal head X1 having improved slip can be formed. Further, since the recording medium P becomes harder to stick to the second layer 25*b*, the printing noise becomes smaller and a thermal printer Z1 having little noise can be provided. Further, since the recording medium P becomes harder to stick to the second layer 25*b*, in a thermal transfer printing method using an ink ribbon, wrinkles become harder to be formed on the ink ribbon. As a result, the thermal head X1 can perform fine printing.

Further, the thermal head X1 in the present disclosure is configured with the skewness Rsk of the second layer 25*b* which is positioned at the two end portions in the long direction larger than the skewness Rsk of the second layer 25*b* which is positioned at the center portion.

According to the above configuration, the crest parts of the second layer 25*b* positioned at the center portion in the long direction become larger configurations than the crest parts of the second layer 25*b* positioned at the two end portions in the long direction. As a result, the contact area of the second layer 25*b* positioned at the center portion in the long direction with the recording medium P becomes larger than the contact area of the second layer 25*b* positioned at the two end portions in the long direction with the recording medium P. For this reason, in the long direction, the friction force between the recording medium P and the second layer 25*b* becomes larger in the center portion than that in the two end portions.

Therefore, when wrinkles are going to be formed on the recording medium P, the wrinkles can be released from the center portion in the long direction toward the two end portions having a small friction force. As a result, together with the conveyance of the recording medium P, the wrinkles are stretched, therefore wrinkles become harder to be formed on the recording medium P.

Figure 6:
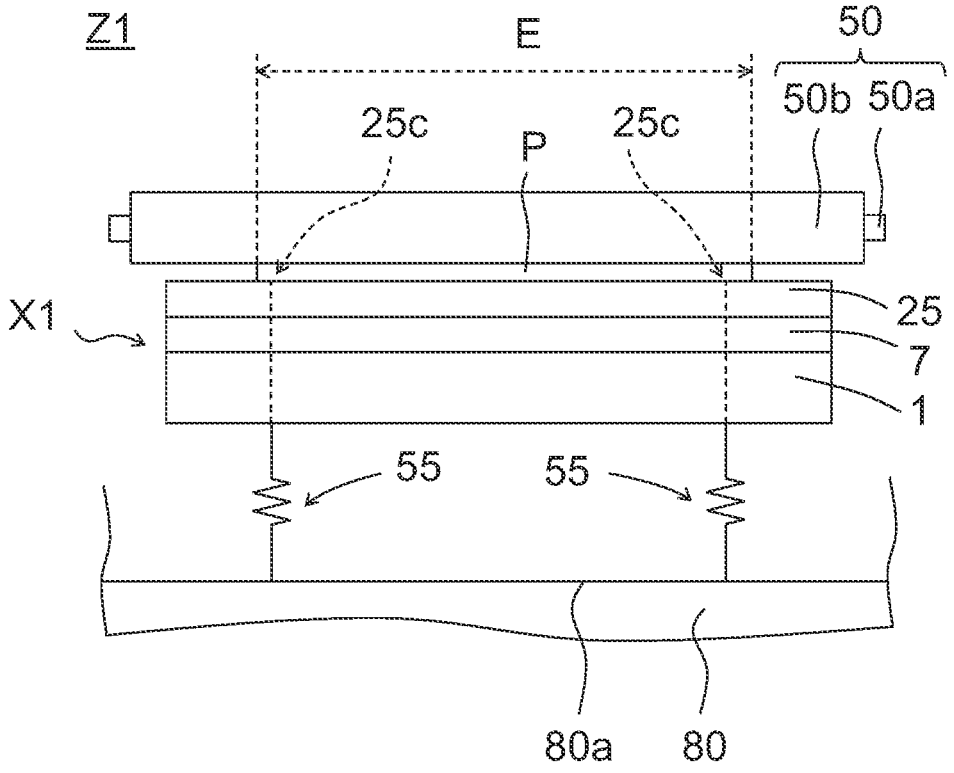
FIG. 6 is a schematic view showing attachment of the thermal head in the thermal printer shown in FIG. 5.

Note that, the two end portions in the long direction mean the regions shown in FIG. 6 from the ends in the sub-scanning direction of the area E contacting the recording medium P in the protective layer 25 up to 25% of length in the length of the area E contacting the recording medium P in the protective layer 25. Further, the center portion in the long direction means a region from each short side of the area E contacting the recording medium P in the protective layer 25 up to 25% to 75% of length in the length in the long direction of the area E contacting the recording medium P in the protective layer 25.

The arithmetic average roughness Ra, skewness Rsk, and kurtosis Rku can be measured according to for example JIS B 0601 (2013). Note that, for measurement, use can be made of a contact type surface roughness meter or contactless surface roughness meter. For example, use can be made of LEXT OLS4000 made by Olympus. As the measurement conditions, for example, a measurement length may be set to 0.4 mm, a cutoff value may be set to 0.008 mm, a spot diameter may be set to 0.4 μm, and a scanning speed may be set to 1 mm/sec.

Further, the skewness Rsk and kurtosis Rku of the protective layer 25 may be measured at the position of the protective layer 25 positioned on the heat-generating portions 9. In this case, the measurement may be carried out by moving the spot in the sub-scanning direction so as to pass through the protective layer 25 on the heat-generating portions 9. At this time, the skewness Rsk and kurtosis Rku may be measured multiple times and mean values of them may be used as the measurement results.

Note that, the arithmetic average roughness Ra may be measured by using an atomic force microscope (AFM) as well.

The protective layer 25 can be formed by arc plasma type ion plating or hollow cathode type ion plating.

The surface state of the second layer 25*b* can be controlled by the following method. For example, by using sand blasting, polishing, or other mechanical processing, etching, chemical polishing, or other chemical processing, the surface treatment is applied to the surface of the die so as to have the predetermined surface shape. Further, by pushing the surface of the die against the second layer 25*b*, the second layer 25*b* can be given a predetermined surface shape.

Figure 5:
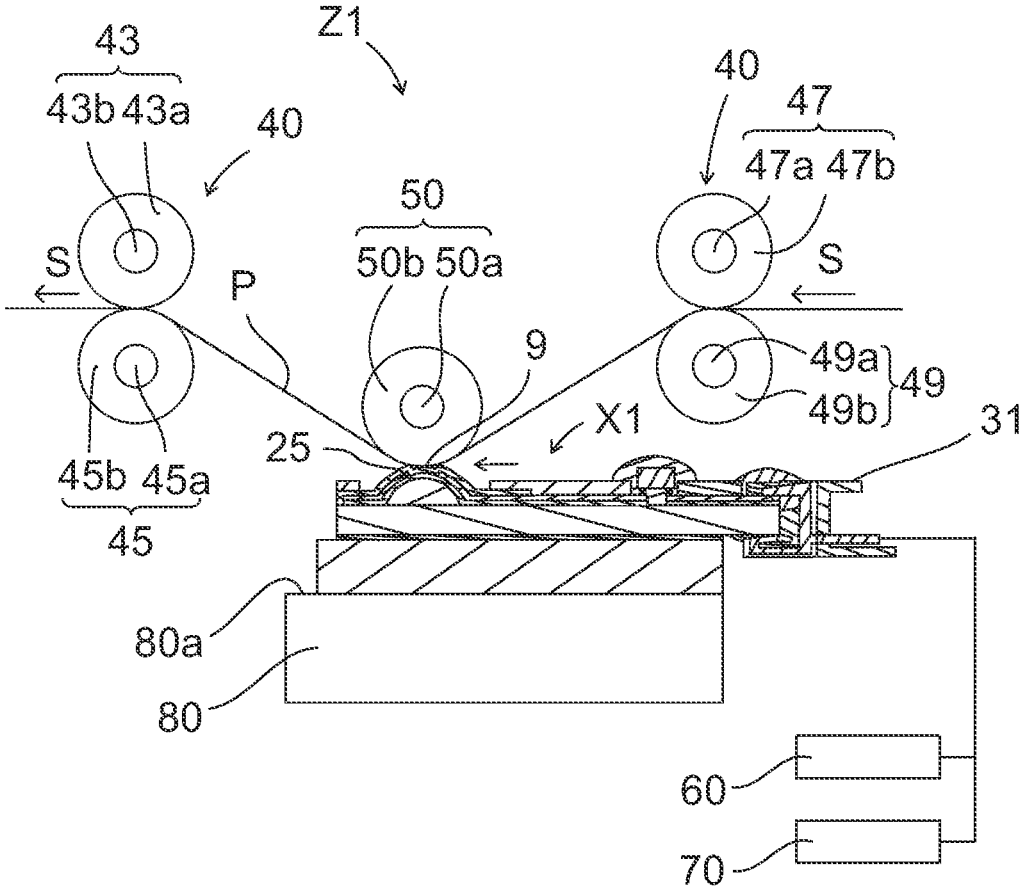
FIG. 5 is a schematic view showing a thermal printer according to the first embodiment.

Next, the thermal printer Z1 having the thermal head X1 will be explained with reference to FIG. 5.

The thermal printer Z1 in the present embodiment is provided with the thermal head X1 explained above, conveyance mechanism 40, platen roller 50, power supply device 60, and control device 70. The thermal head X1 is attached to an attachment surface 80*a* of an attachment member 80 which is arranged in the housing (not shown) of the thermal printer Z1. Note that, the thermal head X1 is attached to the attachment member 80 so as to be along the direction perpendicular to the conveyance direction S, that is, the main scanning direction.

The conveyance mechanism 40 has a driving part (not shown) and conveyance rollers 43, 45, 47, and 49. The conveyance mechanism 40 is one for conveying the recording medium P such as thermal paper, image receiving paper to which ink is transferred, or the like in a direction indicated by an arrow S in FIG. 5 and conveying it onto the protective layer 25 positioned on the plurality of heat-generating portions 9 in the thermal head X1. The driving part has the function of driving the conveyance rollers 43, 45, 47, and 49. For example, use can be made of a motor. The conveyance rollers 43, 45, 47, and 49 for example can be configured as columnar shaft bodies 43*a*, 45*a*, 47*a*, and 49*a* made of stainless steel or another metal covered by elastic members 43*b*, 45*b*, 47*b*, and 49*b* made of butadiene rubber or the like. Note that, when the recording medium P is image receiving paper to which ink is transferred, an ink film (not shown) is conveyed together with the recording medium P between the recording medium P and the heat-generating portions 9 in the thermal head X1.

The platen roller 50 has a function of pressing the recording medium P against the top of the protective layer 25 positioned on the heat-generating portions 9 in the thermal head X1. The platen roller 50 is arranged so as to extend along a direction perpendicular to the conveyance direction S and is supported fixed at the two end parts so that it becomes able to rotate in a state pressing the recording medium P against the tops of the heat-generating portions 9. The platen roller 50, for example, can be configured as a columnar shaft body 50*a* made of stainless steel or another metal covered by an elastic member 50*b* made of butadiene rubber or the like.

The power supply device 60 has a function of supplying current for making the heat-generating portions 9 in the thermal head X1 generate heat as described above and current for making the driving ICs 11 operate. The control device 70 has a function of supplying a control signal controlling the operation of the driving ICs 11 to the driving ICs 11 in order to selectively make the heat-generating portions 9 in the thermal head X1 generate heat as described above.

The thermal printer Z1 presses the recording medium P against the tops of the heat-generating portions 9 in the thermal head X1 by the platen roller 50 while conveying the recording medium P onto the heat-generating portions 9 by the conveyance mechanism 40 and also selectively makes the heat-generating portions 9 generate heat by the power supply device 60 and control device 70 to thereby perform predetermined printing on the recording medium P.

Note that, when the recording medium P is image receiving paper or the like, ink of the ink film (not shown) which is conveyed together with the recording medium P is thermally transferred to the recording medium P to thereby perform printing on the recording medium P.

The thermal printer Z1 in the present disclosure may use cut paper (not shown) as the recording medium P as well. By that, conveyance of the cut paper can be made smooth. That is, the cut paper is conveyed one sheet by one, so a new contact with the protective layer 25 repeatedly occurs each time a new cut paper is conveyed. Therefore, the protective layer 25 is easily abraded.

Contrary to this, in the thermal head X1, the kurtosis Rku of the protective layer 25 is smaller than 3, therefore a certain degree of contact area can be secured by the crests having a large waviness. As a result, stress generated due to the contact with the cut paper can be relieved, therefore the protective layer 25 becomes harder to be abraded.

Note that, as the cut paper, sheet paper or cards or other media other than rolled paper are shown.

Using FIG. 6, attachment of the thermal head X1 to the thermal printer Z1 will be explained. Note that, in FIG. 6, the state where the thermal head X1 is pressed by the platen roller 50 is schematically shown. The protective layer 25 is shown while omitting the double-layer structure.

The thermal head X1 is arranged on pressing members 55 provided on the attachment surface 80*a* of the attachment member 80. The pressing members 55 press against the thermal head X1 in a direction away from the attachment surface 80*a*. For this reason, the thermal head X1 is pressed toward the platen roller 50, so is pressed against the platen roller 50. Due to that, the thermal head X1 can be pressed against the recording medium P passing between the thermal head X1 (protective layer 25) and the platen roller 50 (see FIG. 5), therefore fine printing can be carried out.

As the pressing members 55, use may be made of for example coil springs, plate springs, disc springs, or other springs. Further, member having a low elastic modulus may be used as the pressing members 55 as well.

The recording medium P is pressed against the thermal head X1 by the pressing members 55. The protective layer 25, as shown in FIG. 6, has a region E contacting the recording medium P.

Here, when the thermal head X1 is pressed against the platen roller 50 by the pressing members 55, in the protective layer 25*c* which is arranged at positions corresponding to the pressing members 55, the stress from the pressing members 55 becomes higher compared with the other positions in the protective layer 25. Due to that, the protective layer 25*c* arranged at positions corresponding to the pressing members 55 becomes more easily abraded in terms of environment.

Further, the thermal printer Z1 in the present disclosure may be configured with the kurtosis Rku of the protective layer 25*c* arranged at positions corresponding to the pressing members 55 smaller than the kurtosises Rku of the other portions in the protective layer 25 as well.

Due to that, the contact area between the protective layer 25*c* arranged at positions corresponding to the pressing members 55 and the recording medium P becomes larger than the contact area between the other portions in the protective layer 25 and the recording medium P. As a result, the stress generated in the protective layer 25*c* arranged at positions corresponding to the pressing members 55 can be relieved by a wide contact area, therefore the protective layer 25*c* arranged at positions corresponding to the pressing members 55 becomes harder to be abraded. In turn, the abrasion resistance of the protective layer 25 can be improved.

Further, in the thermal printer Z1 in the present disclosure, the skewness Rsk of the protective layer 25*c* arranged at positions corresponding to the pressing members 55 may be smaller than the skewness Rsk of the protective layer 25 in the other portions as well.

Due to that, the crest parts in the protective layer 25*c* arranged at positions corresponding to the pressing members 55 can be increased more than the crest parts in the protective layer 25 in the other portions. For this reason, the contact area between the protective layer 25*c* arranged at positions corresponding to the pressing members 55 and the recording medium P becomes larger than the contact area between the protective layer 25 in the other portions and the recording medium P. As a result, the stress generated in the protective layer 25*c* arranged at positions corresponding to the pressing members 55 can be relieved by a broad contact area, therefore the protective layer 25*c* arranged at positions corresponding to the pressing members 55 becomes harder to be abraded. In turn, the abrasion resistance of the protective layer 25 can be improved.

Note that, the arithmetic average roughness Ra, kurtosis Rku, and skewness Rsk of the protective layer 25 indicate the arithmetic average roughness Ra, kurtosis Rku, and skewness Rsk of the area E contacting the recording medium P in the surface of the protective layer 25.

As described above, the thermal head in the present disclosure is not limited to the above embodiment. Various changes are possible so long as not departing from the gist. For example, an example in which the protective layer 25 was formed by the first layer 25*a* and second layer 25*b* was shown, but it may be formed by a single layer as well.

Further, a thin film head in which the electrical resistance layer 15 is formed by a thin film and the heat-generating portions 9 is thin was exemplified, but the present disclosure is not limited to this. A thick film head in which the electrical resistance layer 15 is formed by a thick film after patterning various electrodes and the heat-generating portions 9 is thick may be employed as well.

Further, an explanation was given illustrating a flat head in which the heat-generating portions 9 were formed on the first surface 7*f* of the substrate 7. However, it may be an end-face head in which the heat-generating portions 9 are positioned on the end surface of the substrate 7 as well.

Further, the heat-generating portions 9 may also be formed by forming the common electrode 17 and individual electrodes 19 on the heat storage layer 13 and forming the electrical resistance layer 15 only in regions between the common electrode 17 and the individual electrodes 19.

Further, the sealing member 12 may be formed by the same material as that for the coating member 29 coating the driving ICs 11 as well. In that case, when printing the coating member 29, printing may be carried out also in the region for forming the sealing member 12 to simultaneously form the coating member 29 and the sealing member 12.

Further, an example in which the connector 31 was directly connected to the substrate 7 was shown. However, a flexible printed circuit (FPC) may be connected to the substrate 7 as well.

REFERENCE SIGNS LIST

X1 thermal head
Z1 thermal printer
E region contacting recording medium of protective layer
1 heat radiating plate
3 head base body
7 substrate
9 heat-generating portions
11 driving ICs
12 sealing member
13 heat storage layer
14 bonding member
15 electrical resistance layer
17 common electrode
19 individual electrode
21 first connection electrode
25 protective layer
25*a* first layer
25*b* second layer
26 second connection electrode
27 coating layer
31 connector

The invention claimed is:

1. A thermal head comprising:
a substrate;
a heat-generating portion on the substrate;
an electrode which is located on the substrate and is connected to the heat-generating portion; and
a protective layer which coats the heat-generating portion and a part of the electrode, wherein
a kurtosis Rku of the protective layer is smaller than 3, and
the kurtosis Rku of the protective layer at two end portions in a long direction of the substrate is larger than the kurtosis Rku of the protective layer at a center portion in the long direction of the substrate.

2. A thermal printer comprising:
the thermal head according to claim 1;
a conveyance mechanism conveying a recording medium onto the heat-generating portion; and
a platen roller pressing against the recording medium.

3. The thermal printer according to claim 2, further comprising a pressing member which presses the thermal head against the platen roller, wherein
the kurtosis Rku of the protective layer at a position corresponding to the pressing member is smaller than a kurtosis Rku of other portions of the protective layer.

4. The thermal printer according to claim 2, further comprising a pressing member which presses the thermal head against the platen roller, wherein
a skewness Rsk of the protective layer at a position corresponding to the pressing members is smaller than a skewness Rsk of other portions of the protective layer.

5. The thermal printer according to claim 2, wherein the recording medium is cut paper.

6. A thermal head comprising:
a substrate;
a heat-generating portion on the substrate;
an electrode which is located on the substrate and is connected to the heat-generating portion; and
a protective layer which coats the heat-generating portion and a part of the electrode, wherein
a skewness Rsk of the protective layer is smaller than 0, and
the skewness Rsk of the protective layer at two end portions in a long direction of the substrate is larger than the skewness Rsk of the protective layer at a center portion in the long direction of the substrate.

7. A thermal printer comprising:
the thermal head according to claim 6;
a conveyance mechanism conveying a recording medium onto the heat-generating portion; and
a platen roller pressing against the recording medium.

8. The thermal printer according to claim 7, further comprising a pressing member which presses the thermal head against the platen roller, wherein
a kurtosis Rku of the protective layer at a position corresponding to the pressing member is smaller than a kurtosis Rku of other portions of the protective layer.

9. The thermal printer according to claim 7, further comprising a pressing member which presses the thermal head against the platen roller, wherein the skewness Rsk of the protective layer at a position corresponding to the pressing members is smaller than a skewness Rsk of other portions of the protective layer.

10. The thermal printer according to claim 7, wherein the recording medium is cut paper.

* * * * *